US010400592B2

(12) United States Patent
Garcia

(10) Patent No.: US 10,400,592 B2
(45) Date of Patent: Sep. 3, 2019

(54) METHODOLOGY FOR PRESENTING DUMPFLOOD DATA

(71) Applicant: Gonzalo A. Garcia, Katy, TX (US)

(72) Inventor: Gonzalo A. Garcia, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 942 days.

(21) Appl. No.: 14/273,964

(22) Filed: May 9, 2014

(65) Prior Publication Data

US 2014/0336938 A1 Nov. 13, 2014

Related U.S. Application Data

(60) Provisional application No. 61/822,054, filed on May 10, 2013.

(51) Int. Cl.
*E21B 49/08* (2006.01)
*E21B 43/20* (2006.01)

(52) U.S. Cl.
CPC ..... *E21B 49/08* (2013.01); *E21B 43/20* (2013.01)

(58) Field of Classification Search
CPC ..... E21B 49/008; E21B 49/10; G06F 17/5009
See application file for complete search history.

(56) References Cited

U.S. PATENT DOCUMENTS

| | | | | |
|---|---|---|---|---|
| 5,770,798 | A * | 6/1998 | Georgi | E21B 49/10 73/152.05 |
| 6,923,259 | B2 | 8/2005 | Snow | |
| 7,896,079 | B2 | 3/2011 | Dyer et al. | |
| 2003/0066649 | A1 | 4/2003 | Koot et al. | |
| 2013/0199787 | A1 * | 8/2013 | Dale | E21B 43/26 166/302 |

OTHER PUBLICATIONS

Rawding et al., "Application of Intelligent Well Completion for Controlled Dumpflood in West Kuwait", SPE 112243, 2008 SPE Intelligent ENergy Conference and Exhibition, Amsterdam, The Netherlands, Feb. 25-27, 2008, 11 pages.

* cited by examiner

*Primary Examiner* — Elias Desta
(74) *Attorney, Agent, or Firm* — Cantor Colburn LLP

(57) ABSTRACT

A non-transitory computer-readable medium includes computer-executable instructions for presenting dumpflood data to a user by implementing steps on a computer. The steps include: receiving first data describing a first subsurface volume; receiving second data describing a second subsurface volume that is deeper than the first subsurface volume; calculating pressures required for a fluid to flow in a borehole from the first volume to the second volume as a function of vertical height of the first volume (h1), permeability of the first volume (k1), vertical height of the second volume (h2), permeability of the second volume (k2), a first damage factor (S1) representing damage to the first volume, and a second damage factor (S2) representing damage to the second volume; and displaying on a computer display a graphical representation of the calculated pressures and inputs used to calculate the pressures.

22 Claims, 44 Drawing Sheets

Settings

In[104]:= `Remove["Global`*"]`

Pressure Drop through the porous media

The upper and lower zone are described with the Darcy radial flow equation through the porous media. It is assumed that the skin factor include all the pressure drop not included in the Darcy's equation as: deviations, perforations and gravel pack. In english unit the equation is as follows:

In[105]:= $\text{UpperZ} = q1 == 0.00708 \frac{k1\ h1}{\mu 1\ \text{FVF1}} \frac{\Delta P1}{\text{Log}\left[\frac{re}{rw}\right] + S1};$ $\text{LowerZ} = q2 == 0.00708 \frac{k2\ h2}{\mu 2\ \text{FVF2}} \frac{\Delta P2}{\text{Log}\left[\frac{re}{rw}\right] + S2};$ $\text{MassBal} = q1 == q2;$ The flow rate between both zones are the same according the conservation of mass, mass come in equal to mass come out. It is assumed that the fluid viscosities will not change between zones since it is incompresible fluid; as well as the formation volumetric factor.

Solving the reservoir flow equations (2 momentum equation and mass equation) can be found the following relationship In[108]:= `Eliminate[{UpperZ, LowerZ, MassBal}, {q1, q2}]`

FIG.4A

Out[108]= $$h1\ k1\ \Delta P1 == \frac{FVF1\ h2\ k2\ \Delta P2\ \mu 1\ \left(S1 + Log\left[\frac{re}{rw}\right]\right)}{FVF2\ \mu 2\ \left(S2 + Log\left[\frac{re}{rw}\right]\right)}\ \&\&\ FVF1 \neq 0.\ \&\&$$

$$FVF2 \neq 0.\ \&\&\ \mu 1 \neq 0.\ \&\&\ \mu 2 \neq 0.\ \&\&\ S1 + Log\left[\frac{re}{rw}\right] \neq 0.\ \&\&\ S2 + Log\left[\frac{re}{rw}\right] \neq 0.$$

The natural logaritm term in the radial flow equation is considered aprox. 8, for a drainage area of 1000 ft and 8 1/2 feet hole size.

In[109]:= Log[(1000.)/((0.5/2)/12)]

Out[109]= 7.94574

Therefore, the following assumptions can be re - written as:
q1 = q2; μ1=μ2; FVF1=FVF2 and $Log[\frac{re}{rw}] = 7.94 \sim 8$ In[110]:= $$\mathbf{Eliminate[\{UpperZ,\ LowerZ,\ MassBal\},\ \{q1,\ q2\}]\ /.\ \left\{\mu 1 \to \mu 2,\ FVF1 \text{ -> } FVF2,\ Log\left[\frac{re}{rw}\right] \to 8\right\}}$$

FIG.4B

Out[110]= $h1\ k1\ \Delta P1 == \frac{h2\ k2\ (8 + S1)\ \Delta P2}{8 + S2}$ && FVF2 ≠ 0. &&
FVF2 ≠ 0. && μ2 ≠ 0. && μ2 ≠ 0. && 8 + S1 ≠ 0. && 8 + S2 ≠ 0.

In order to simplify the previuos equation were defined two dimensionless variables; one for the ratio between thickness and permeability between the reservoirs and other one for the ratio between skin factors.

In[111]:=
```
Equat1 =
 ΔP1 == Solve[%[[1]], {ΔP1}][[1, 1, 2]] /. {h2 k2 → Kratio h1 k1} /. {8 + S2 → Sratio (8 + S1)}
```

Out[111]= $\Delta P1 == \frac{Kratio\ \Delta P2}{Sratio}$

The pressure drop through the reservoir (drawdown) is also defined as the differential pressure between the reservoir pressure and the flowing bottom hole pressure, in each reservoir layers, inside the wellbore

FIG.4C

```
In[112]:= Drawdown1 = ΔP1 == Pr1 - Pwf1;
          Drawdown2 = ΔP2 == Pr2 - Pwf2;
          LowerPres = Pr2 == Pr1 + PresGrad L;

In[115]:= Eliminate[{Drawdown1, Drawdown2, Equat1}, {ΔP1, ΔP2}][[1]] // FullSimplify
```

Out[115]= $Pr1 + \frac{Kratio\ (-Pr2 + Pwf2)}{Sratio} == Pwf1$

```
In[116]:= Equat2 = Pwf2 == Solve[%, Pwf2][[1, 1, 2]] // FullSimplify
```

Out[116]= $Pr2 + \frac{(-Pr1 + Pwf1)\ Sratio}{Kratio} == Pwf2$

```
In[117]:= Equat3 = Eliminate[{Equat2, LowerPres}, {Pr2}][[1]] // FullSimplify
```

Out[117]= $Pr1 + L\ PresGrad + \frac{(-Pr1 + Pwf1)\ Sratio}{Kratio} == Pwf2$

Replacing Pwf2 in the wellbore pressure drop equation, can be getting the follow equation. This equation (ΔP12) describes the differential pressure drop between both reservoirs without include the wellbore pressure drop; which will be developed and integrated in the next section. The equation establish the relationship between the upper reservoir pressure, the upper flowing bottom hole pressure, the permeability ratio, the skin ratio, the pressure gradient and distance between reservoirs.

FIG.4D

```
In[118]:= WellborePresDrop = ΔP12 == Pwf1 - Pwf2;
In[119]:= Equat4 = Eliminate[{WellborePresDrop, Equat3}, {Pwf2}]
```

Out[119]= $\Delta P12 == -Pr1 - L\ PresGrad + Pwf1 + \frac{Pr1\ Sratio}{Kratio} - \frac{Pwf1\ Sratio}{Kratio}\ \&\&\ Kratio \neq 0$

```
In[120]:= WellborePres = Equat4[[1]]
```

Out[120]= $\Delta P12 == -Pr1 - L\ PresGrad + Pwf1 + \frac{Pr1\ Sratio}{Kratio} - \frac{Pwf1\ Sratio}{Kratio}$

Pressure Drop in the wellbore between reservoirs

The pressure drop, between reservoirs, inside the wellbore is estimated by the Darcy Weisbach equation. The Darcy Weisbach estimates the pressure drop through a pipe as a function of the friction factor (ff - dimensionless), the length of the pipe (L - feet), the hydraulic diameter (Dh - feet), the mixture fluid density ($\rho$, lbm/ft^3) and the mixture fluid velocity (v - ft/second). The "gc" term is a conversion factor needed for consistent units (gc = 32.2 (lbm ft)/(lbf s^2)). The friction factor is estimated by Swamee Jain equation, this equation establish that some corrections to the pressure drop are required to properly describe the fluid flow through a pipe. The friction factor correlation is a function of the Reynold Number, the hydraulic diameter and rougness of the pipe (called RoughH). Both equations (Darcy Weisbach and Swamee Jain) are integrated to come up with the friction pressure drop equation as function of Reynold Number, hydraulic diameter and flow velocity.

FIG.4E

In[121]:= $$\text{DarcyWeisbach} = \Delta Pf == ff \frac{L}{Dh} \rho \frac{v^2}{2\, gc\, 144}$$

$$(*\ \rho - \text{lbm/cuft},\ v - \text{ft/s},\ gc - \frac{\text{lbm ft}}{\text{lbf s}^2},\ \Delta P - \text{PSI}\ *);$$

$$\text{GravitationalEffect} = \Delta Pg == \frac{grav\, \rho\, L}{gc\, 144} (*\ grav - \frac{\text{ft}}{\text{s}^2},$$

$$\rho - \text{lbm/cuft},\ L - \text{ft},\ gc - 32.2 \frac{\text{lbm ft}}{\text{lbf s}^2},\ \Delta P - \text{PSI}\ *);$$

$$\text{SwameeJain} = ff == \frac{0.25}{\text{Log10}\left[\frac{\text{RoughH}}{3.7\, Dh} + \frac{5.74}{\text{Re}^{0.9}}\right]^2};$$

$$\text{ReynoldNumber} = \text{Re} == 1488 \frac{\rho\, v\, Dh}{\mu} (*\ Dh - \text{ft},\ v - \text{ft/s},\ \rho - \text{lbm/cuft},\ \mu - \text{cP}\ *);$$

In[125]:= FrictionalEffect =
ΔPf == Solve[{DarcyWeisbach, SwameeJain, ReynoldNumber}, {ΔPf, ff, Re }] [[1, 1, 2]]

FIG.4F

Out[125]= $$\Delta Pf == \frac{0.00460234\, L\, v^2\, \rho}{Dh\, gc\, Log\left[\frac{0.27027\, RoughH}{Dh} + \frac{0.00800883}{\left(\frac{Dh\, v\, \rho}{\mu}\right)^{9/10}}\right]^2}$$

Integrated Model - Reservoir & Hydraulic wellbore pressure drop model

The injection system will be balanced when the wellbore and reservoir pressures are equalized. This pressure drop balance will determine an analytical expression defined with the main technical variables affecting the injection system.

In[126]:=
```
Equat5 =
 GravitationalEffect[[2]] - FrictionalEffect[[2]] == WellborePres[[2]] /. Pwf1 → RPres Pr1
```

Out[126]= $$\frac{grav\, L\, \rho}{144\, gc} - \frac{0.00460234\, L\, v^2\, \rho}{Dh\, gc\, Log\left[\frac{0.27027\, RoughH}{Dh} + \frac{0.00800883}{\left(\frac{Dh\, v\, \rho}{\mu}\right)^{9/10}}\right]^2} ==$$

FIG.4G $$-\mathrm{Pr1} - \mathrm{L}\,\mathrm{PresGrad} + \mathrm{Pr1}\,\mathrm{RPres} + \frac{\mathrm{Pr1}\,\mathrm{Sratio}}{\mathrm{Kratio}} - \frac{\mathrm{Pr1}\,\mathrm{RPres}\,\mathrm{Sratio}}{\mathrm{Kratio}}$$

In[127]:= LenCalculated = Solve[Equat5, {L}][[1, 1, 2]]

Out[127]=

$$\left(-1.\,\mathrm{Pr1} + 1.\,\mathrm{Pr1}\,\mathrm{RPres} + \frac{1.\,\mathrm{Pr1}\,\mathrm{Sratio}}{\mathrm{Kratio}} - \frac{1.\,\mathrm{Pr1}\,\mathrm{RPres}\,\mathrm{Sratio}}{\mathrm{Kratio}}\right) \Big/ \left(\mathrm{PresGrad} + \frac{0.00694444\,\mathrm{grav}\,\rho}{\mathrm{gc}} - \frac{0.00460234\,\mathrm{v}^2\,\rho}{\mathrm{Dh}\,\mathrm{gc}\,\mathrm{Log}\left[\frac{0.27027\,\mathrm{RoughH}}{\mathrm{Dh}} + \frac{0.00800883}{\left(\frac{\mathrm{Dh}\,\mathrm{v}\,\rho}{\mu}\right)^{9/10}}\right]^2}\right)$$

In[128]:= **PresGrad = $\frac{62.4}{144}$ (* psi/ft*) ;**

FIG.4H

```
RoughH = 0.0006/12 (* in Roughness height *);
grav = 32.2 (* ft/s^2 *);
gc = 32.2 (* lbm ft/(lbf s^2) *);
Cvalue = 300; (* dimensionless - Cvalue defines the maximum flow
  velocity to not exceed the erosion velocity - based on API 14 RP *)
ρ = 62.4 (* water density *);
μ = 1 (* water viscosity *);
```

In[135]:= LenCalculated

Out[135]=

$$\frac{-1.\,\mathrm{Pr1} + 1.\,\mathrm{Pr1}\,\mathrm{RPres} + \frac{1.\,\mathrm{Pr1}\,\mathrm{Sratio}}{\mathrm{Kratio}} - \frac{1.\,\mathrm{Pr1}\,\mathrm{RPres}\,\mathrm{Sratio}}{\mathrm{Kratio}}}{0.866667 - \frac{0.00891882\,v^2}{\mathrm{Dh}\,\mathrm{Log}\left[\frac{0.0000135135}{\mathrm{Dh}} + \frac{0.000194045}{(\mathrm{Dh}\,v)^{9/10}}\right]^2}}$$

FIG.4I

In[136]:= LengthbetRes[Pr1_, RPres_, Dh_, Kratio_, Sratio_, v_] :=

$$\text{Module}\left[\{\},\ \left(\left(-\text{Pr1} + \text{Pr1 RPres} + \frac{\text{Pr1 Sratio}}{\text{Kratio}} - \frac{\text{RPres Pr1 Sratio}}{\text{Kratio}}\right) \Big/ \left(0.8667 - \frac{0.008919\, v^2}{\text{Dh Log}\left[\frac{0.000013514}{\text{Dh}} + \frac{0.00019405}{(\text{Dh v})^{9/10}}\right]^2}\right)\right)\right]$$

```
In[137]:= Equat6 = Equat5 /. { Dh -> 2.992, RPres → 0.2, Kratio -> 1.5, Sratio -> 1.2}
          Equat6 /. {Pr1 → 3000, v → 20}
          Equat6 /. {Pr1 → 1000, v → 40}
```

$$\left\{\text{LengthbetRes}\left[3000, 0.2, \frac{2.992}{12}, 3, 1.5, 20\right], \text{LengthbetRes}\left[1000, 0.2, \frac{2.992}{12}, 3, 1.5, 40\right]\right\}$$

FIG.4J

Out[137]= $0.433333\,L - \frac{0.00298089\,L\,v^2}{\mathrm{Log}\left[4.51655\times10^{-6} + \frac{0.0000723665}{V^{9/10}}\right]^2} == -0.433333\,L - 0.16\,Pr1$ Out[138]= $0.424434\,L == -480. - 0.433333\,L$ Out[139]= $0.399373\,L == -160. - 0.433333\,L$ Out[140]= {-1719.04, -1771.49}

In[141]:= `FlowRateEst[v_, d_] := v (π/4 d^2) 86400/5.615 ;(*v - ft/s, d - ft, FlowRateEst - bpd *)`

In[142]:= `FlowRateEst[20, {1.995/12, 2.441/12, 2.992/12}]`

Out[142]= {6680.47, 10001.3, 15026.}

In[143]:= `FlowRateEst[40, {1.995/12, 2.441/12, 2.992/12}]`

Out[143]= {13360.9, 20002.6, 30052.1}

In[144]:= `Clear[Kratio, Sratio]`

FIG.4K

```
In[145]:= RatioKS[Pr_, dia_, vel_] := ContourPlot[LengthbetRes[Pr, 0.2, dia/12, Kratio, Sratio, vel],
    {Kratio, 0.1, 4}, {Sratio, 0.5, 4}, FrameLabel → {Kratio - (h2 k2/(h1 k1)), Sratio - ((8 + S2)/(8 + S1))},
    PlotLabel → "Distance between Reservoirs for water injection",
    Contours → {1000, 500, 200, 50, 0, -50, -200, -500, -1000},
    ContourShading → {Purple, Blue, Green, Yellow, Red, Yellow, Green, Blue, Purple, White},
    ContourLabels → True]

In[146]:= RatioKS[1000, 2.995, 20]
```

FIG.4L

Out[146]=

In[147]:= GraphicsGrid[{{RatioKS[1000, 2.995, 20], RatioKS[1000, 2.995, 40]},
{RatioKS[3000, 2.995, 20], RatioKS[3000, 2.995, 40]}}]

In[148]:= GraphicsRow[{RatioKS[3000, 2.995, 20], RatioKS[1000, 2.995, 40]}]

Out[148]=

```
In[149]:= LenPlot3[Pr_, dia_, Kratio_, Sratio_] :=
  Plot[LengthbetRes[Pr, 0.2, dia/12, Kratio, Sratio, vel], {vel, 0, 40},
   PlotStyle → {Red, Blue, Green, Orange}, Frame → True, PlotLabel → Style["",
     FontFamily → "Arial", FontSize → 12, FontWeight → "Bold", FontSlant → "Italic"],
   FrameLabel → {"Flow Velocity, ft/s", "Distance between reservoirs, ft", None, None}]
```

Maximum Flow Velocity to not exceed erosion limits

The flow rate is restricted to the erosion velocity which is estimated with the API RP 14E; it is assumed a C 300. The Cvalue represents a experimental or field value obtained to describe the maximum flow velocity through a given geometry (i.e. a pipe). Experimental values shows that C equal to 300 can be used as constraint the flow rate in facilities (pipes) using as fluid the water. The erosion velocity is the maximum flow velocity allowed in a given geometry without erode the material. This velocity is based on no sand production.

```
In[150]:= API14RP = Verosion == Cvalue/Sqrt[ρ] (* ft *);

In[151]:= API14RP

Out[151]= Verosion == 37.9777
```

FIG.4Q

Dumpflood Quicklook Evaluation

```
Remove["Global`*"]

Manipulate[
 Module[{Cvalue = 300, ρ = 62.4, grav = 32.2, gc = 32.2},
  FlowRateEst[v_, d_] := v (π/4 d^2) 86400/5.615 ;(*v - ft/s, d - ft, FlowRateEst - bpd *);
  Verosion[Cvalue_, ρ_] := Cvalue/Sqrt[ρ] (* ft *);
  FlowR[h1_, k1_, S1_, ΔP1_] := Module[{μ1, FVF1, re, rw, q},
    μ1 = 1 (* cP *);
    FVF1 = 1 (* bbl/STB *);
```

FIG.4R $$re = 1000\ (*\ ft\ *);$$

$$rw = \frac{\frac{8.5}{2}}{12}\ (*\ ft\ *);$$

$$q = 0.00708\ \frac{k1\ h1}{\mu 1\ FVF1}\ \frac{\Delta P1}{\mathrm{Log}\left[\frac{re}{rw}\right] + S1}\Bigg];$$

$$\mathrm{LengthbetRes}[Pr1_,\ RPres_,\ Dh_,\ Kratio_,\ Sratio_,\ v_] :=$$

$$\mathrm{Module}\left[\{\},\ \left(\frac{-Pr1 + Pr1\ RPres + \frac{Pr1\ Sratio}{Kratio} - \frac{RPres\ Pr1\ Sratio}{Kratio}}{0.8667 - \frac{0.008919\ v^2}{Dh\ \mathrm{Log}\left[\frac{0.000013514}{Dh} + \frac{0.00019405}{(Dh\ v)^{9/10}}\right]^2}}\right)\right];$$

FIG.4S $$\text{PresDropReq}[L_] := \frac{\text{grav}\,\rho\,L}{\text{gc}\,144}\left(* \ \text{grav} - \frac{\text{ft}}{s^2}, \rho - \text{lbm/cuft},\right.$$

$$\left. L - \text{ft},\ \text{gc} - 32.2\,\frac{\text{lbm ft}}{\text{lbf } s^2},\ \Delta P - \text{PSI} \ *\right);$$

$$\text{Krat}[h1_,\ k1_,\ h2_,\ k2_] := \frac{h2\,k2}{h1\,k1};$$

$$\text{Srat}[S1_,\ S2_] := \frac{8 + S2}{8 + S1};$$

```
Kcal = Krat[H1, K1, H2, K2] 1.;
Scal = Srat[S1, S2] 1.;
Drawdown = (1 - RPres) Pr;
Qcal = FlowR[H1, K1, S1, Drawdown];
```

$$\text{vel} = \text{Solve}\left[\text{FlowRateEst}\left[v,\ \frac{\text{dia}}{12}\right] == \text{Qcal},\ v\right][[1,\ 1,\ 2]];$$

FIG.4T

```
Lcal = LengthbetRes[Pr, RPres, dia/12, Kcal, Scal, vel];
PDcal = PresDropReq[Lcal];
Pwf1 = Pr - Drawdown;
Pwf2 = Pwf1 + PDcal;
InjNoInj = If[Pwf2 ≥ Pr2, "Water Injection", "No Water Injection"];
Text@
 Style[
  Grid[
   {{Column[{
       Switch[plotType,
        1, ContourPlot[LengthbetRes[Pr, RPres, dia/12, Kratio, Sratio, vel], {Kratio, 0.1,
```

FIG.4U

```
4}, {Sratio, 0.5, 4}, FrameLabel → {"Kratio -(h2 k2/(h1 k1))", "Sratio - (8 + S2/(8 + S1))"},
PlotLabel → "", Contours → {1000, 500, 200, 50, 0, -50, -200, -500, -1000},
ContourShading → {Purple, Blue, Green, Yellow, Red, Yellow,
  Green, Blue, Purple, White}, ContourLabels → True,
Epilog → {PointSize[0.05], Point[{Kcal, Scal}]}, ImageSize → {600, 420}],
2, ContourPlot[LengthbetRes[Pr, RPres, dia/12, Kratio, Sratio, vel], {Kratio, 0.1,
4}, {Sratio, 0.5, 4}, FrameLabel → {"Kratio -(h2 k2/(h1 k1))", "Sratio - (8 + S2/(8 + S1))"},
PlotLabel → "", Contours → {1000, 500, 200, 50, 0, -50, -200, -500, -1000},
ContourShading → {Purple, Blue, Green, Yellow, Red, Yellow,
  Green, Blue, Purple, White}, ContourLabels → True,
Epilog → {PointSize[0.05], Point[{Kcal, Scal}]}, ImageSize → {600, 420}],
3, ContourPlot[LengthbetRes[Pr, RPres, dia/12, Kratio, Sratio, vel], {Kratio, 0.1,
4}, {Sratio, 0.5, 4}, FrameLabel → {"Kratio -(h2 k2/(h1 k1))", "Sratio - (8 + S2/(8 + S1))"},
```

FIG.4V

```
  PlotLabel → "", Contours → {1000, 500, 200, 50, 0, -50, -200, -500, -1000},
  ContourShading → {Purple, Blue, Green, Yellow, Red, Yellow,
    Green, Blue, Purple, White}, ContourLabels → True,
  Epilog → {PointSize[0.05], Point[{Kcal, Scal}]}, ImageSize → {600, 420}],
 4, ContourPlot[LengthbetRes[Pr, RPres, dia/12, Kratio, Sratio, vel], {Kratio, 0.1,
   4}, {Sratio, 0.5, 4}, FrameLabel → {"Kratio -(h2 k2/(h1 k1))", "Sratio - (8 + S2/(8 + S1))"},
  PlotLabel → "", Contours → {1000, 500, 200, 50, 0, -50, -200, -500, -1000},
  ContourShading → {Purple, Blue, Green, Yellow, Red, Yellow,
    Green, Blue, Purple, White}, ContourLabels → True,
  Epilog → {PointSize[0.05], Point[{Kcal, Scal}]}, ImageSize → {600, 420}]
],
Switch[plotType,
 1, Column[{TraditionalForm[Text[Column[{
```

FIG.4W

```
Style[Row[{"KH ratio = ",
   NumberForm[Kcal, {3, 2}, NumberPadding → {"", "0"}]}], Black, 14],
Style[Row[{"Form Damage ratio = ", NumberForm[Scal,
    {3, 2}, NumberPadding → {"", "0"}]}], Black, 14],
Style[Row[{"Drawdown, psi = ", NumberForm[Drawdown,
    {3, 2}, NumberPadding → {"", "0"}]}], Black, 14],
Style[Row[{"Upper FBHP, psi = ", NumberForm[Pwf1, {3, 2},
    NumberPadding → {"", "0"}]}], Black, 14],
Style[Row[{"Injection/No Injection = ", InjNoInj}], Black, 14],
Style[Row[{"Flow rate, stbd = ", NumberForm[FlowRateEst[vel, dia/12.],
    {5, 0}, NumberPadding → {"", "0"}]}], Black, 14],
Style[Row[{"Flow velocity, ft/s = ", NumberForm[vel,
    {3, 2}, NumberPadding → {"", "0"}]}], Black, 14],
Style[Row[{"Pressure Drop (-ESP;+No ESP), psig = ",
```

FIG.4X

```
      NumberForm[PDcal, {5, 0}, NumberPadding → {"", "0"}]}], Black, 14],
    Style[Row[{"Max Flow rate, stbd =", NumberForm[FlowRateEst[
        Verosion[Cvalue, ρ], dia/12.], {11, 0}, NumberPadding → {"", "0"}]}],
     Black, 14]}, Frame → False, Alignment → Center]]],
Which[
 Kcal <= 1 && Scal ≤ 1 && PDcal ≤ 0,
 Style["Upper zone able to provide fluids but lower zone with low
    injectivity. Evaluate upper zone formation damage,
    due to flow restrictions in the porous media its
    reduces water flow rate injection capability.
    Depends on reservoir type evaluate: acidizing,
    fracturing or re-perforating. Additional pressure
    requirements to satisfactory water injection,
```

FIG.4Y

```
    considers ESP, evaluate casing size limitations.
    If upper oil concentration exceed 50000 ppm (5%)
    then evaluate downhole water separation technology.
    Lower reservoir pressure must be lower than upper
    FBHP for water injection; maximum flow rate given
    by lower reservoir pressure - low rate could be
    controlled with  IWS (if enough room is available
    to fit the HCM_A - downhole control valve inside
    the ID casing)", Black, 14, TextAlignment → Center],
Kcal <= 1 && Scal ≤ 1 && PDcal > 0, Style["Upper zone able to provide
    fluids but lower zone with low injectivity. Evaluate
    upper zone formation damage, due to flow restrictions
    in the porous media its reduces water flow rate
    injection capability. Depends on reservoir type
    evaluate: acidizing, fracturing or re-perforating.
    If upper oil concentration exceed 50000 ppm (5%)
    then evaluate downhole water separation technology.
```

FIG.4Z

```
    Enough injection pressure, in small casing size
    use DTS - distributed temperature sensor otherwise
    downhole flowmeter as flow rate measurement
    technique", Black, 14, TextAlignment → Center],
Kcal <= 1 && Scal > 1 && PDcal ≤ 0, Style["Upper zone able to provide
    fluids but lower zone with low injectivity. Evaluate
    lower zone formation damage, due to flow restrictions
    in the porous media its reduces water flow rate
    injection capability. Depends on reservoir type
    evaluate: acidizing, fracturing or re-perforating. If
    upper oil concentration exceed 50000 ppm (5%) then
    evaluate downhole water separation technology. Enough
    injection pressure, in small casing size use DTS
    otherwise downhole flowmeter as flow rate measurement
    technique", Black, 14, TextAlignment → Center],
```

FIG.4AA

```
Kcal <= 1 && Scal > 1 && PDcal > 0, Style["Upper zone able to provide
    fluids but lower zone with low injectivity. Evaluate
    lower zone formation damage, due to flow restrictions
    in the porous media its reduces water flow rate
    injection capability. Depends on reservoir type
    evaluate: acidizing, fracturing or re-perforating.
    If upper oil concentration exceed 50000 ppm (5%)
    then evaluate downhole water separation technology.
    Additional pressure requirements to satisfactory
    water injection, considers ESP, evaluate casing size
    limitations", Black, 14, TextAlignment → Center],
Kcal > 1 && Scal ≤ 1 && PDcal ≤ 0, Style["Low PI in the Upper zone
    and high injectivity in the lower zone. Evaluate
    upper zone formation damage, due to flow restrictions
    in the porous media it reduces water flow rate
    injection capability. Depends on reservoir type
    evaluate: acidizing, fracturing or re-perforating.
```

FIG.4BB

```
    Additional pressure requirements to satisfactory
    water injection, considers ESP, evaluate casing size
    limitations. If upper oil concentration exceed 50000
    ppm (5%) then evaluate downhole water separation
    technology", Black, 14, TextAlignment → Center],
Kcal > 1 && Scal ≤ 1 && PDcal > 0, Style["Low PI in the Upper zone and
    high injectivity in the lower zone. Evaluate lower
    zone formation damage, due to flow restrictions in
    the porous media it reduces water flow rate injection
    capability. Depends on reservoir type evaluate:
    acidizing, fracturing or re-perforating. Enough
    injection pressure, in small casing size use DTS
    otherwise downhole flowmeter as flow rate measurement
    technique. IWS can provide flow control and
    measurement. If upper oil concentration exceed 50000
    ppm (5%) then evaluate downhole water separation
    technology", Black, 14, TextAlignment → Center],
```

FIG.4CC

```
Kcal > 1 && Scal > 1 && PDcal ≤ 0, Style["High level of injectivity
    and low deliverability; reducing the upper formation
    damage will increase the water injection flow rate.
    Additional pressure requirements to satisfactory
    water injection, considers ESP, evaluate casing size
    limitations. If upper oil concentration exceed 50000
    ppm (5%) then evaluate downhole water separation
    technology", Black, 14, TextAlignment → Center],
Kcal > 1 && Scal > 1 && PDcal > 0, Style["High level of injectivity
    and low deliverability; reducing the upper formation
    damage will increase the water injection flow rate.
    IWS for downhole flow control and measurement.
    If upper oil concentration exceed 50000 ppm
    (5%) then evaluate downhole water separation
    technology", Black, 14, TextAlignment → Center]]
}, Dividers → All],
```

FIG.4DD

```
2, TraditionalForm[Text[Column[{Style[Row[{"KH ratio = ",
      NumberForm[Kcal, {3, 2}, NumberPadding → {"", "0"}]}], Black, 14],
    Style[Row[{"Form Damage ratio = ", NumberForm[Scal, {3, 2},
       NumberPadding → {"", "0"}]}], Black, 14],

    Style[Row[{"Drawdown, psi = ", NumberForm[Drawdown, {3, 2},
       NumberPadding → {"", "0"}]}], Black, 14],
    Style[Row[{"Upper FBHP, psi = ", NumberForm[Pwf1, {3, 2},
       NumberPadding → {"", "0"}]}], Black, 14],
    Style[Row[{"Flow rate, stbd = ", NumberForm[FlowRateEst[vel, dia/12.],
       {5, 0}, NumberPadding → {"", "0"}]}], Black, 14],
    Style[Row[{"Flow velocity, ft/s = ", NumberForm[vel,
       {3, 2}, NumberPadding → {"", "0"}]}], Black, 14],
    Style[Row[{"Pressure Drop (-ESP;+No ESP), psig = ",
      NumberForm[PDcal, {5, 0}, NumberPadding → {"", "0"}]}], Black, 14],
    Style[Row[{"Max Flow rate, stbd =", NumberForm[
```

FIG.4EE

```
        FlowRateEst[Verosion[Cvalue, ρ], dia/12.], {11, 0},
        NumberPadding → {"", "0"}]}], Black, 14]}, Frame → False]]],
3, TraditionalForm[Text[Column[{Style[Row[{"KH ratio = ",
      NumberForm[Kcal, {3, 2}, NumberPadding → {"", "0"}]}], Black, 14],
    Style[Row[{"Form Damage ratio = ", NumberForm[Scal, {3, 2},
        NumberPadding → {"", "0"}]}], Black, 14],
    Style[Row[{"Drawdown, psi = ", NumberForm[Drawdown, {3, 2},
        NumberPadding → {"", "0"}]}], Black, 14],
    Style[Row[{"Upper FBHP, psi = ", NumberForm[Pwf1, {3, 2},
        NumberPadding → {"", "0"}]}], Black, 14],
    Style[Row[{"Flow rate, stbd = ", NumberForm[FlowRateEst[vel, dia/12.],
        {5, 0}, NumberPadding → {"", "0"}]}], Black, 14],
    Style[Row[{"Flow velocity, ft/s = ", NumberForm[vel,
        {3, 2}, NumberPadding → {"", "0"}]}], Black, 14],
```

FIG.4FF

```
    Style[Row[{"Pressure Drop (-ESP;+No ESP), psig = ",
       NumberForm[PDcal, {5, 0}, NumberPadding → {"", "0"}]}], Black, 14],
    Style[Row[{"Max Flow rate, stbd =", NumberForm[
        FlowRateEst[Verosion[Cvalue, ρ], dia/12.], {11, 0},
        NumberPadding → {"", "0"}]}], Black, 14]}, Frame → False]]],
4, TraditionalForm[Text[Column[{Style[Row[{"KH ratio = ",
       NumberForm[Kcal, {3, 2}, NumberPadding → {"", "0"}]}], Black, 14],
    Style[Row[{"Form Damage ratio = ", NumberForm[Scal, {3, 2},
        NumberPadding → {"", "0"}]}], Black, 14],
    Style[Row[{"Drawdown, psi = ", NumberForm[Drawdown, {3, 2},
        NumberPadding → {"", "0"}]}], Black, 14],
    Style[Row[{"Upper FBHP, psi = ", NumberForm[Pwf1, {3, 2},
        NumberPadding → {"", "0"}]}], Black, 14],
    Style[Row[{"Flow rate, stbd = ", NumberForm[FlowRateEst[vel, dia/12.],
```

FIG.4GG

```
                {5, 0}, NumberPadding → {"", "0"}]}], Black, 14],
            Style[Row[{"Flow velocity, ft/s = ", NumberForm[vel,
                {3, 2}, NumberPadding → {"", "0"}]}], Black, 14],
            Style[Row[{"Pressure Drop (-ESP;+No ESP), psig = ",
               NumberForm[PDcal, {5, 0}, NumberPadding → {"", "0"}]}], Black, 14],
            Style[Row[{"Max Flow rate, stbd =", NumberForm[
                FlowRateEst[Verosion[Cvalue, ρ], dia/12.], {11, 0},
                NumberPadding → {"", "0"}]}], Black, 14]}, Frame → False]]]
        ]}]}}]]
],

{{plotType, 1, "Plot"},
 {1 → "Operational Windows"},
 ControlPlacement → Top},
"                                                                    ",
Style["Dumpfloow Operational Windows", Black, Bold, 24],
Delimiter,
```

FIG.4HH

```
Style["Operating Point", ColorData[1, 1], Bold],
Style["Upper Zone Permeability", Bold],
{{K1, 100, "K1 (md)"}, K1Min, K1Max, 1., Appearance → "Labeled", ImageSize → Tiny},
Style["Lower Zone Permeability", Bold],
{{K2, 200, "K2 (md)"}, K2Min, K2Max, 1., Appearance → "Labeled", ImageSize → Tiny},
Style["Upper Zone Thickness", Bold],
{{H1, 40, "H1 (ft)"}, H1Min, H1Max, .5, Appearance → "Labeled", ImageSize → Tiny},
Style["Lower Zone Thickness", Bold],
{{H2, 30, "H2 (ft)"}, H2Min, H2Max, .5, Appearance → "Labeled", ImageSize → Tiny},
Style["Upper Zone Form Damage", Bold],
{{S1, 1, "S1 (none)"}, S1Min, S1Max, .01, Appearance → "Labeled", ImageSize → Tiny},
Style["Lower Zone Form Damage", Bold],
{{S2, 1, "S2 (none)"}, S2Min, S2Max, .01, Appearance → "Labeled", ImageSize → Tiny},
Delimiter,
Style["Operational Window", ColorData[1, 1], Bold],
Style["Upper Reservoir Pressure", Bold],
{{Pr, 4000, Row[{"Pr (Psi)"}]}, PrMin,
 PrMax, 1., Appearance → "Labeled", ImageSize → Tiny},
Style["Upper FBHP/Pr Ratio", Bold],
{{RPres, .2, Row[{"RPres (none)"}]}, RPresMin,
 RPresMax, 0.01, Appearance → "Labeled", ImageSize → Tiny},
```

FIG.4II

```
Style["Lower Reservoir Pressure", Bold],
{{Pr2, 4000, Row[{"Pr2 (Psi)"}]}, Pr2Min,
 Pr2Max, 1., Appearance → "Labeled", ImageSize → Tiny},
Style["Tubing diameter", Bold],
{{dia, 2.992, "dia (in)"}, diaMini,
 diaMax, .01, Appearance → "Labeled", ImageSize → Tiny},

ControlPlacement → {Left}, TrackedSymbols → True,
Initialization :→ (PrMin = 10; PrMax = 5000.; Pr2Min = 10;
  Pr2Max = 5000; diaMini = 1.; diaMax = 7.; K1Min = 1; K1Max = 10 000.; K2Min = 1.;
  K2Max = 10 000.; H1Min = 1.; H1Max = 1000.; H2Min = 1.; H2Max = 1000.; S1Min = -5.;
  S1Max = 10; S2Min = -5.; S2Max = 10.; RPresMin = 0.01; RPresMax = 1.0)]
```

The terms deliverability and injectivity are used in this software to describe the capability of the reservoir to produce or inject fluids depending on the pressure applied on it. The productivity index is the ratio between the flow rate and pressure drop through the reservoir; the higher the drawdown or pressure drop through the reservoir the higher the flow rate. The terms high or low define an orden of magnitud (dimensionless) related to the injectivity, deliverability and productivity index. Typically, a high value of PI, deliverability or injectivity refer to values greater than 5. However, the reservoir pressure will establish how high the indicator is. Low productivity index will be around 0.5 stbd/psi (stbd - standard total barrels per day, psi - pounds per square inch).

FIG.4JJ

KH ratio = 1.50
Form Damage ratio = 2.37
Drawdown, psi = 3200.00
Upper FBHP, psi = 800.00
Injection/No Injection = No Water Injection
Flow rate, stbd = 16052.
Flow rate velocity, ft/s = 21.40
Pressure Drop (−ESP; + No ESP), psig = 1193.
Max Flow rate, stbd = 28533.

---

High level of injectivity and low deliverability; reducing the upper formation damage will increase the water injection flow rate. IWS for downhole flow control and measurement. If upper oil concentration exceed 50000 ppm (5%) then evaluate downhole water separation technology.

45

Line BB

FIG.4MM

METHODOLOGY FOR PRESENTING DUMPFLOOD DATA

CROSS REFERENCE TO RELATED APPLICATIONS

This application claims the benefit of an earlier filing date from U.S. Provisional Application Ser. No. 61/822,054 filed May 10, 2013, the entire disclosure of which is incorporated herein by reference.

BACKGROUND

Dumpflooding is a method by which water in a formation reservoir is flowed to another formation reservoir that typically contains oil. The addition of water to the oil reservoir provides the reservoir support pressure necessary for oil production. There are many variables that determine if the water can flow naturally or if technical intervention is required to achieve the desired flow. Attempts to manipulate the many variables to determine different scenarios for injecting the water may lead to confusion and add to the planning time. It would be well received in the oil drilling industries if techniques could be developed to improve the planning efficiency for dumpflooding.

BRIEF SUMMARY

Disclosed is a non-transitory computer-readable medium includes computer-executable instructions for presenting dumpflood data to a user by implementing steps on a computer. The steps include: receiving first data describing a first subsurface volume; receiving second data describing a second subsurface volume that is deeper than the first subsurface volume; calculating pressures required for a fluid to flow in a borehole from the first volume to the second volume as a function of vertical height of the first volume (h1), permeability of the first volume (k1), vertical height of the second volume (h2), permeability of the second volume (k2), a first damage factor (S1) representing damage to the first volume, and a second damage factor (S2) representing damage to the second volume, wherein the calculating uses the first data and the second data; and displaying on a computer display a graphical representation of the calculated pressures and inputs used to calculate the pressures.

Also disclosed is a method for presenting dumpflood data to a user. The method includes: receiving first data describing a first subsurface volume using a computer processing system; receiving second data describing a second subsurface volume that is deeper than the first subsurface volume using the computer processing system; calculating, using the computer processing system, pressures required for a fluid to flow in a borehole from the first volume to the second volume as a function of vertical height of the first volume (h1), permeability of the first volume (k1), vertical height of the second volume (h2), permeability of the second volume (k2), a first damage factor (S1) representing damage to the first volume, and a second damage factor (S2) representing damage to the second volume, wherein the calculating uses the first data and the second data; and displaying on a computer display a graphical representation of the calculated pressures and inputs used to calculate the pressures.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the figures.

Disclosed is a method for planning for flowing a fluid (also referred to as dumpflooding) from a first subsurface reservoir to a second subsurface reservoir that is beneath the first reservoir. In one or more embodiments, the fluid is the upper reservoir is water and the lower reservoir contains oil. The water is injected either by gravity and/or pump from the upper reservoir into the lower reservoir via a borehole connecting the two reservoirs. It can be appreciated that different types of equipment and technologies are available to transfer the water. The method, which is implemented by a computer processing system, allows for easily inputting and changing any of several variables that may be used to calculate pressures that are required for flowing the water into the lower reservoir under different conditions for each reservoir. The calculated pressures are displayed to a user using a graph displayed on a computer display or monitor. An indicator point displayed on the graph represents the current conditions of the two reservoirs and the pressure required corresponding to the current conditions. By observing the indicator point, a user can select from available options of equipment and technology to provide an optimal solution for flowing the water. For example, the user may observe from the graph that the pressure from gravity is sufficient to flow the water and no further intervention may be required. In another example, the user may observe from the graph that the pressure from gravity is not alone sufficient to flow the water and further intervention such as using submersible pumps is required. In yet another example, the user may observe from the graph that reservoir damage is too great to flow the water and remediation such as by re-perforating a formation, fracturing the formation, or acid stimulation is required. By observing the graph and the indicator point and having the capability to easily change input variables such as borehole size and reservoir damage factors, the user can quickly evaluate a multitude of scenarios to determine the optimal solution for flowing the water.

Figure 1:
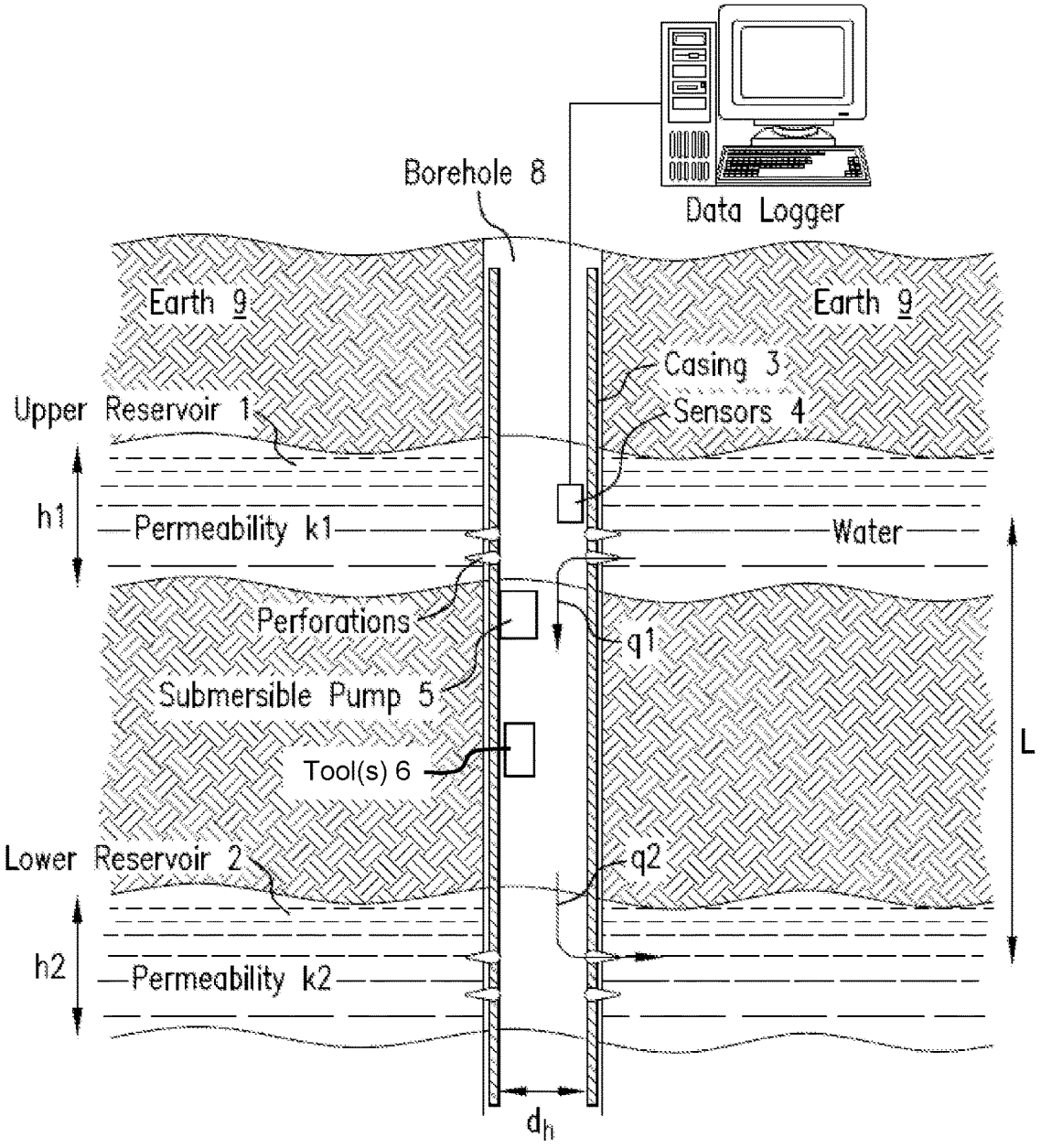
FIG. 1 illustrates a cross-sectional view of an exemplary embodiment of dumpflooding between two reservoirs.

FIG. 1 illustrates a cross-sectional view of an exemplary embodiment of dumpflooding between an upper reservoir 1 and a lower reservoir 2. A borehole 8 penetrating earth 9 connects the two reservoirs. The borehole 8 may be lined with a casing 3. Sensors 4 may disposed in or near the borehole 8 in order to measure properties associated with flowing a fluid (e.g., water) from the upper reservoir 1 to the lower reservoir 2. Non-limiting embodiments of the sensors 4 include a temperature sensor, a pressure sensor, and a flow sensor. A submersible pump 5, such as an electrical submersible pump, may be disposed in the borehole 8 to increase the injection pressure to a pressure required for flowing the fluid into the lower reservoir 2. Other tools 6 may also be used such as a perforating gun for perforating the casing 3 and/or the borehole wall to lessen flow resistance. Another tool 6 may be a formation fracturing tool having a plurality of components required for fracturing a formation. Yet another tool 6 that may be used is an acid stimulation tool configured to inject acid into a reservoir in order to stimulate fluid flow. In case of high oil concentration in water in the upper reservoir, another tool 6 may be a downhole water separator (DWS) that can be installed for clean water injection into the lower reservoir.

The flow rate q1 of the fluid flowing from the upper reservoir 1 may be mathematically represented as: $q1=0.00708((k1\cdot h1)/(\mu1\cdot FVF1))\cdot\Delta P1/(\text{Log}[re/rw]+S1)$. The flow rate q2 of the fluid flowing into the lower reservoir 9 may be mathematically represented as $q2=0.00708((k2\cdot h2)/(\mu2\cdot FVF2))\cdot\Delta P2/(\text{Log}[re/rw]+S2)$. In the above two equations, k1 represents permeability (millidarcy) of the upper reservoir, k2 represents permeability (millidarcy) of the lower reservoir, μ1 represents viscosity (centipoise) of the fluid flowing from the upper reservoir; μ2 represents the viscosity (centipoise) of the fluid flowing into the lower reservoir; FVF1 is Formation Volumetric Factor (bbl/STB) (STB=standard total barrels)) for the upper reservoir representing a change in fluid volume due to a pressure or temperature change; FVF2 is Formation Volumetric Factor (bbl/STB) for the lower reservoir representing a change in fluid volume due to a pressure or temperature change; re represents the radius (feet) of a drainage sump surrounding the borehole; and rw represents the flow radius (feet) of the borehole.

The wellbore pressure difference (psi) between the two formations may be represented as $\Delta P_{12}=[(\rho gL)/(g_c144)]-[f(L/dh)\rho\upsilon^2/(2g_c144)]$ where ρ is fluid density (lbm/ft3), g is gravity (32.2 ft/sec$^2$), $g_c$ is conversion factor (32.2 (lbm·ft/(lbf·sec$^2$)), f is friction factor (dimensionless), dh is hydraulic diameter, and υ is flow velocity (ft/sec).

The distance (L) between the two reservoirs may be represented as $L=[Pr1(RP_{res}-1+(S_{ratio}/K_{ratio})(1-RP_{res})]/[0.87-(0.0089\upsilon^2/(dh\ \text{Log}\ [(0.00001351/dh)+(0.000194/(dh\upsilon)^{9/10}]^2]$, which is determined using the mass and momentum equations describing flow between both reservoirs, where Pr1 is reservoir pressure (psi) of upper reservoir and $RP_{res}$ is the ratio of reservoir pressure with no flow to reservoir pressure with fluid flow. $S_{ratio}=(S2+8)/(S1+8)$ where S1 is a damage factor of the upper reservoir and S2 is a damage factor the lower reservoir. The damage factor relates to an increased amount of pressure required to have a fluid flow at the same rate that the fluid would flow at in an undamaged reservoir. $K_{ratio}=(h2k2)/(h1k1)$ where h1 is the thickness (feet) of the upper reservoir and h2 is the thickness (feet) of the lower reservoir. Both the $S_{ratio}$ and the $K_{ratio}$ are dimensionless.

It can be appreciated that reservoir pressure differential required for dumpflooding may be calculated from the above equations knowing that mass balance requires q1=q2.

Figure 2:
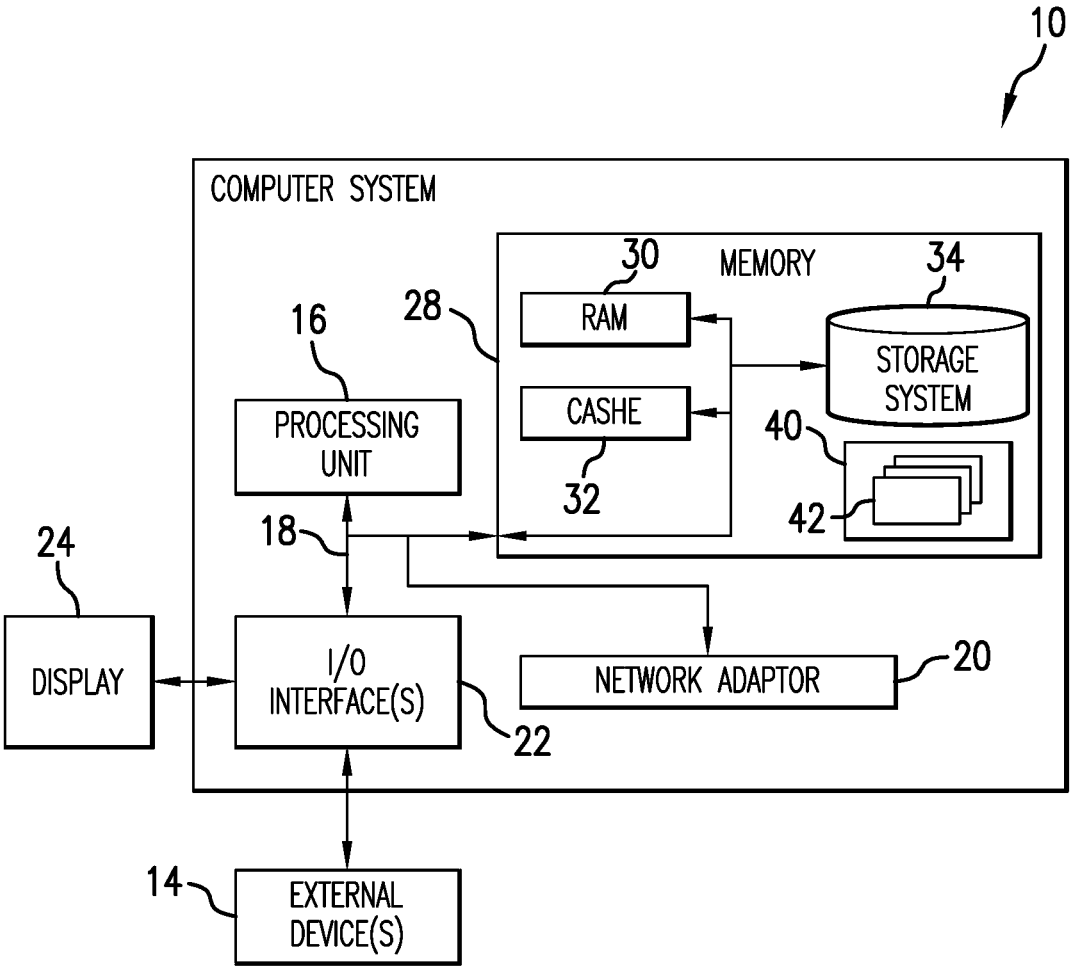
FIG. 2 depicts aspects of a computer processing system for implementing a method for presenting data used to plan dumpflooding between the two reservoirs.

FIG. 2 depicts a block diagram of a computer system for implementing the teachings disclosed herein according to an embodiment. Referring now to FIG. 2, a block diagram of a computer system 10 suitable for providing communication over cross-coupled links between independently managed compute and storage networks according to exemplary embodiments is shown. Computer system 10 is only one example of a computer system and is not intended to suggest any limitation as to the scope of use or functionality of embodiments described herein. Regardless, computer system 10 is capable of being implemented and/or performing any of the functionality set forth hereinabove.

Computer system 10 is operational with numerous other general purpose or special purpose computing system environments or configurations. Examples of well-known computing systems, environments, and/or configurations that may be suitable for use with computer system 10 include, but are not limited to, personal computer systems, server computer systems, thin clients, thick clients, cellular telephones, handheld or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system 10 may be described in the general context of computer system-executable instructions, such as program modules, being executed by the computer system 10. Generally, program modules may include routines, programs, objects, components, logic, data structures, and so on that perform particular tasks or implement particular abstract data types. Computer system 10 may be practiced in distributed cloud computing environments where tasks are performed by remote processing devices that are linked through a communications network. In a distributed computing environment, program modules may be located in both local and remote computer system storage media including memory storage devices.

As shown in FIG. 2, computer system 10 is shown in the form of a general-purpose computing device, also referred to as a processing device. The components of computer system may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system 10 may include a variety of computer system readable media. Such media may be any available media that is accessible by computer system/server 10, and it includes both volatile and non-volatile media, removable and non-removable media.

System memory 28 can include computer system readable media in the form of volatile memory, such as random access memory (RAM) 30 and/or cache memory 32. Computer system 10 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the disclosure.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system 10 may also communicate with one or more external devices 14 such as a keyboard, a pointing device, a display 24, etc.; one or more devices that enable a user to interact with computer system/server 10; and/or any devices (e.g., network card, modem, etc.) that enable computer system/server 10 to communicate with one or more other computing devices. Such communication can occur via Input/Output (I/O) interfaces 22. Still yet, computer system 10 can communicate with one or more networks such as a local area network (LAN), a general wide area network (WAN), and/or a public network (e.g., the Internet) via network adapter 20. As depicted, network adapter 20 communicates with the other components of computer system 10 via bus 18. It should be understood that although not shown, other hardware and/or software components could be used in conjunction with computer system 10. Examples include, but are not limited to: microcode, device drivers, redundant processing units, external disk drive arrays, RAID systems, tape drives, and data archival storage systems, etc.

Figure 3:
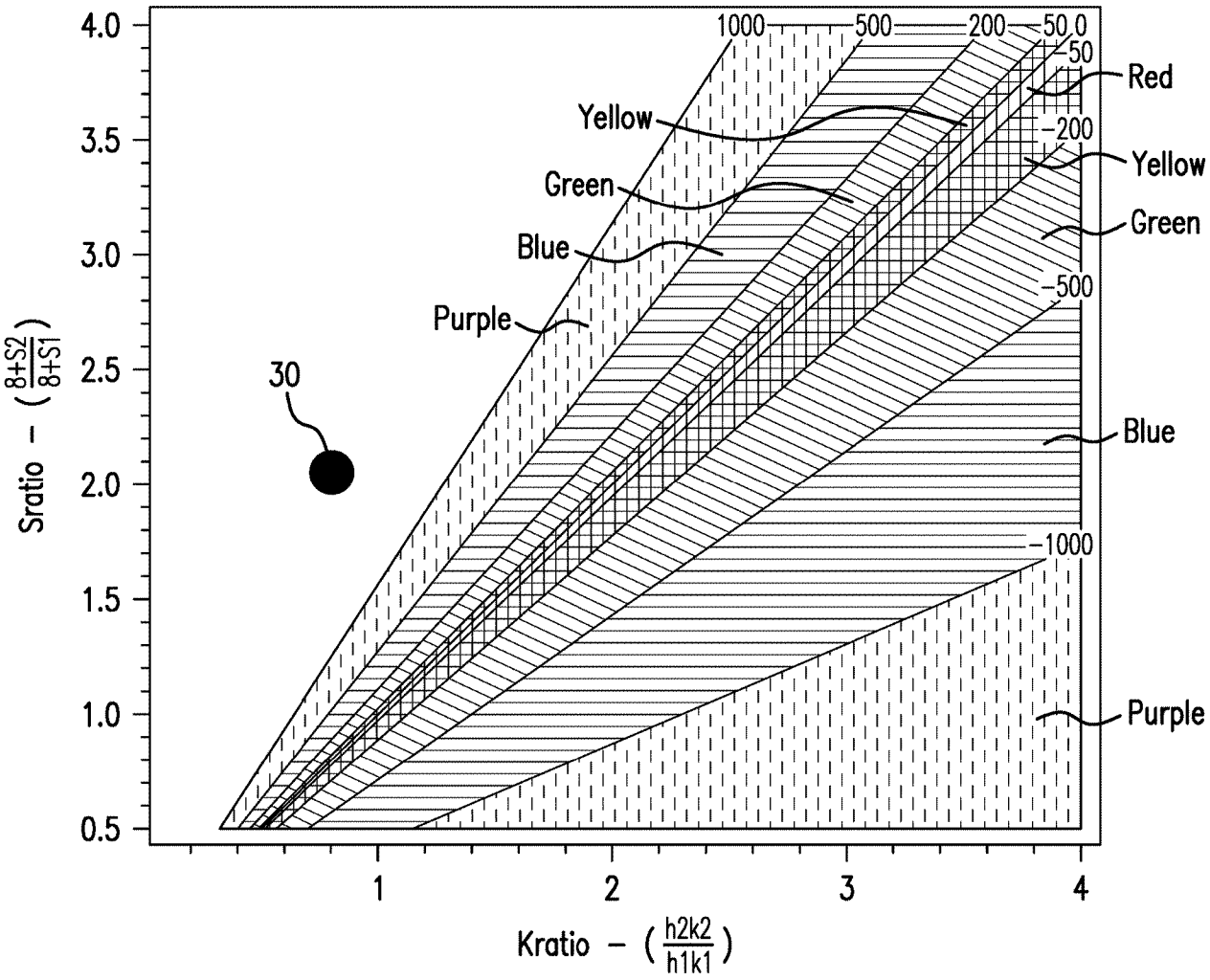
FIG. 3 depicts aspects of an exemplary display of pressures required for dumpflooding based on specific conditions of the two reservoirs.

Reference may now be had to FIG. 3 depicting aspects of an exemplary display of pressures required for dumpflooding based on specific conditions of the upper and lower reservoirs. On the left vertical axis is the S-ratio (denoted Sratio=(8+S2)/(8+S1)), which is dependent on a damage factor of each reservoir. As used herein subscript (1) is used to associate a factor with the upper reservoir 1 and subscript (2) is used to associate a factor with the lower reservoir 2. On the lower horizontal axis, the K-ratio (denoted Kratio=(h2·k2)/(h1·k1)) is dependent on the vertical height of each reservoir (h1 and h2) and the permeability of each reservoir (k1 and k2). On the upper horizontal axis, a range of pressures are presented that are sufficient to flow the fluid using gravity alone without need for pumping. These pressures are presented in terms of height of a static water column. On the right vertical axis, a range of pressures are presented that require pumping in lieu of or in addition to the force of gravity. An indicator point 30 indicates the required pressure for fluid flow for the current reservoir conditions. If the indicator point 30 falls to the left of the diagonal line intersecting the upper right corner of the display, then no additional pumping and associated pumps are required to flow the fluid. If the indicator point 30 falls to the right of the diagonal line intersecting the upper right corner of the display, then additional pumping and associated pumps are required to flow the fluid. If the indicator point 30 falls close to the diagonal line, then the required flow pressure is sensitive to reservoir conditions and some intervention may be prudent so as not to waste time or material assuming no intervention is required when reservoir conditions may not be exactly as assumed.

Reference may now be had to FIG. 4 depicting aspects of an example of a computer program that implements the teachings herein. Exemplary computer program inputs and a resulting graphic output display for dumpflood planning are provided. The term "IN[*]" relates to a computer program input and the term "OUT[*]" relates to an output of the computer program resulting from a computer program input, while "*" is a sequence number. Annotations are provided to describe different aspects of the computer program. In the embodiment of FIG. 4, the Mathematica© software package available from Wolfram Research was employed. Certain definitions are now provided for abbreviations used in FIG. 4:

μ1 represents viscosity of the fluid flowing from the first volume;

μ2 represents the viscosity of the fluid flowing into the second volume;

FVF1 is Formation Volumetric Factor for the first volume representing a change in fluid volume due to a pressure or temperature change;

FVF2 is Formation Volumetric Factor for the second volume representing a change in fluid volume due to a pressure or temperature change;

re represents the radius of a drainage sump surrounding the borehole; and rw represents the flow radius of the borehole.

Figure 4M:
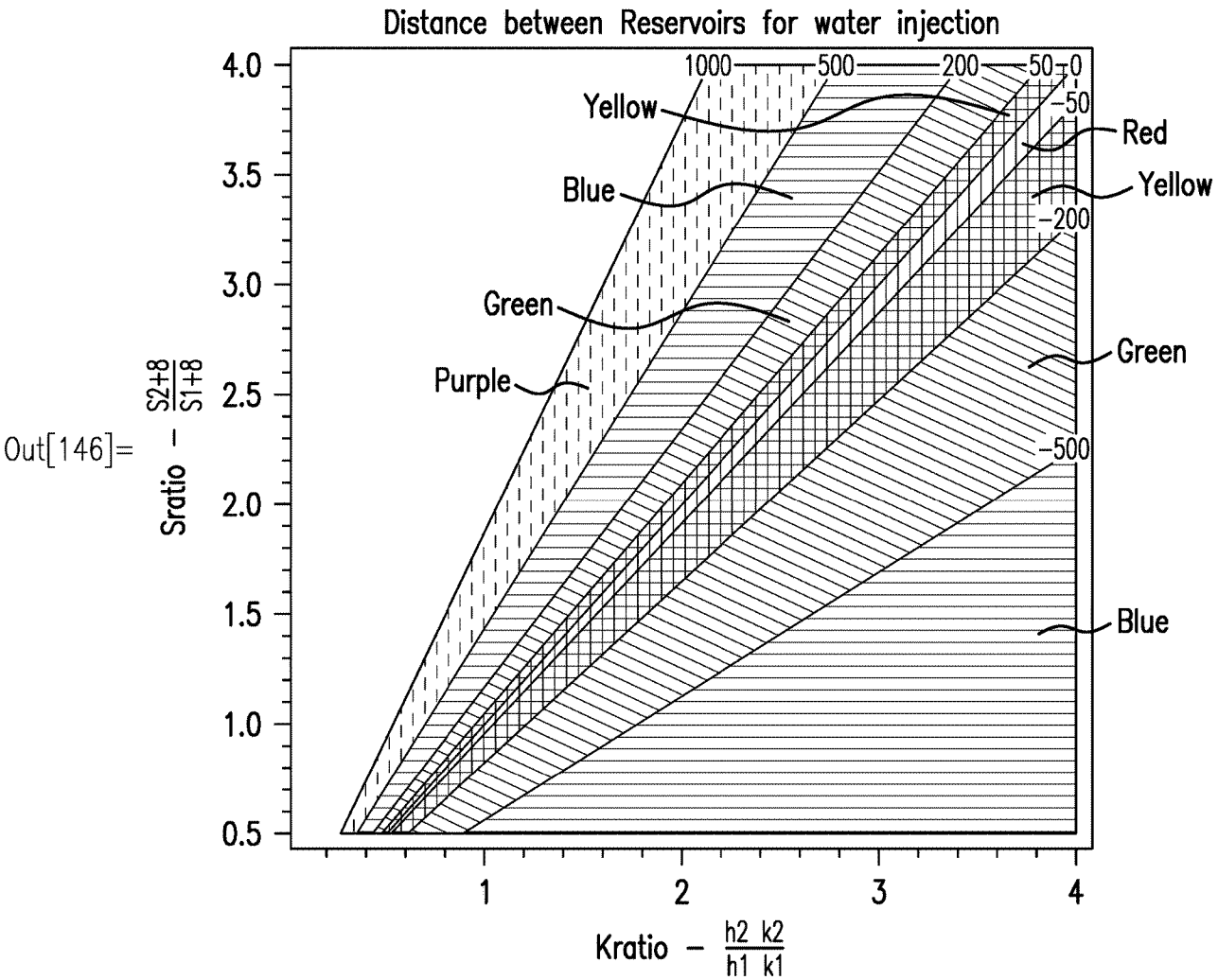
FIGS. 4A-4MM, collectively referred to as FIG. 4, depict aspects of an example of computer inputs, computer outputs and a resulting graphic output display for dumpflood planning.
Figure 4N:
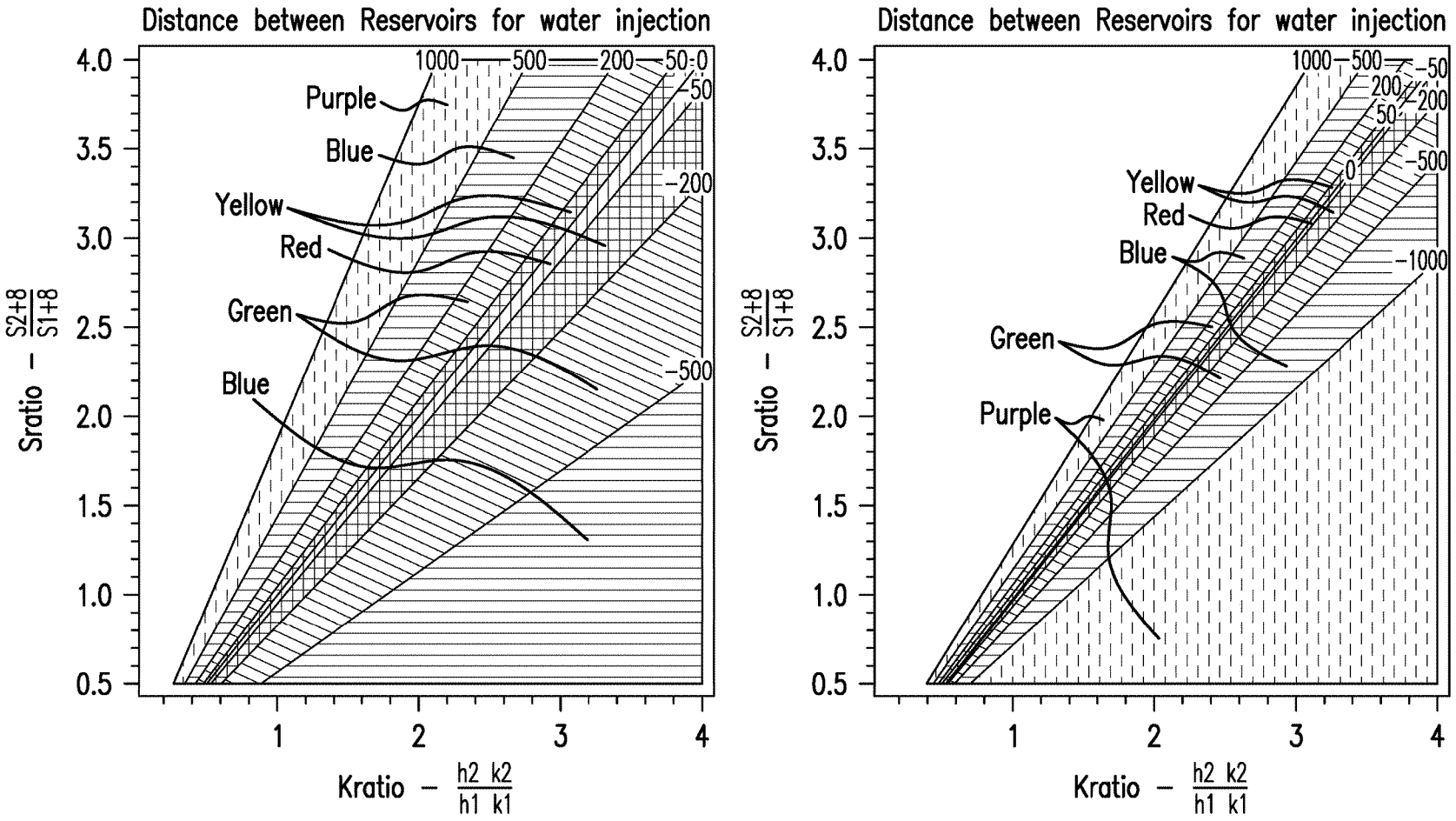
Figure 4O:
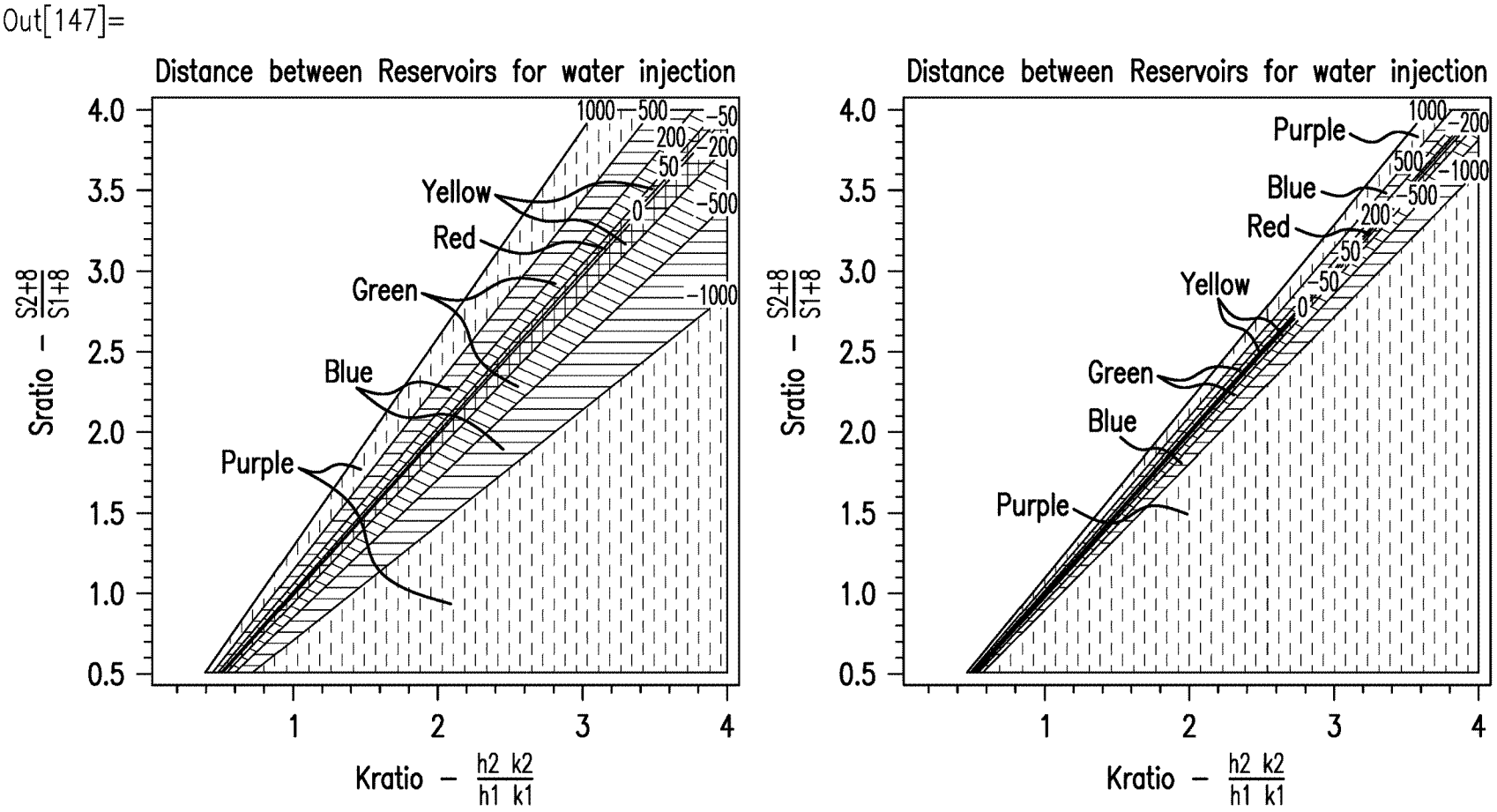
Figure 4P:
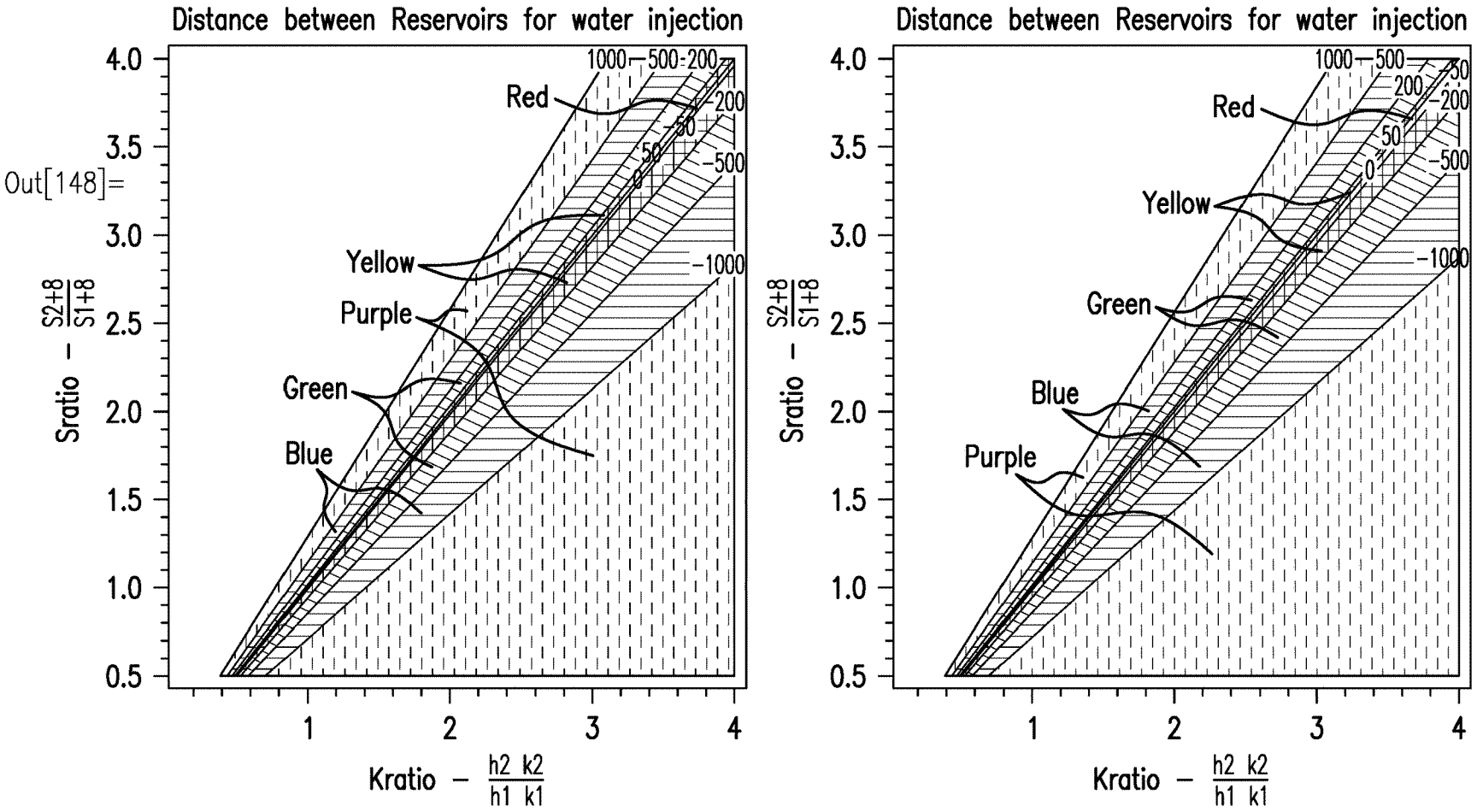
Figure 4K:
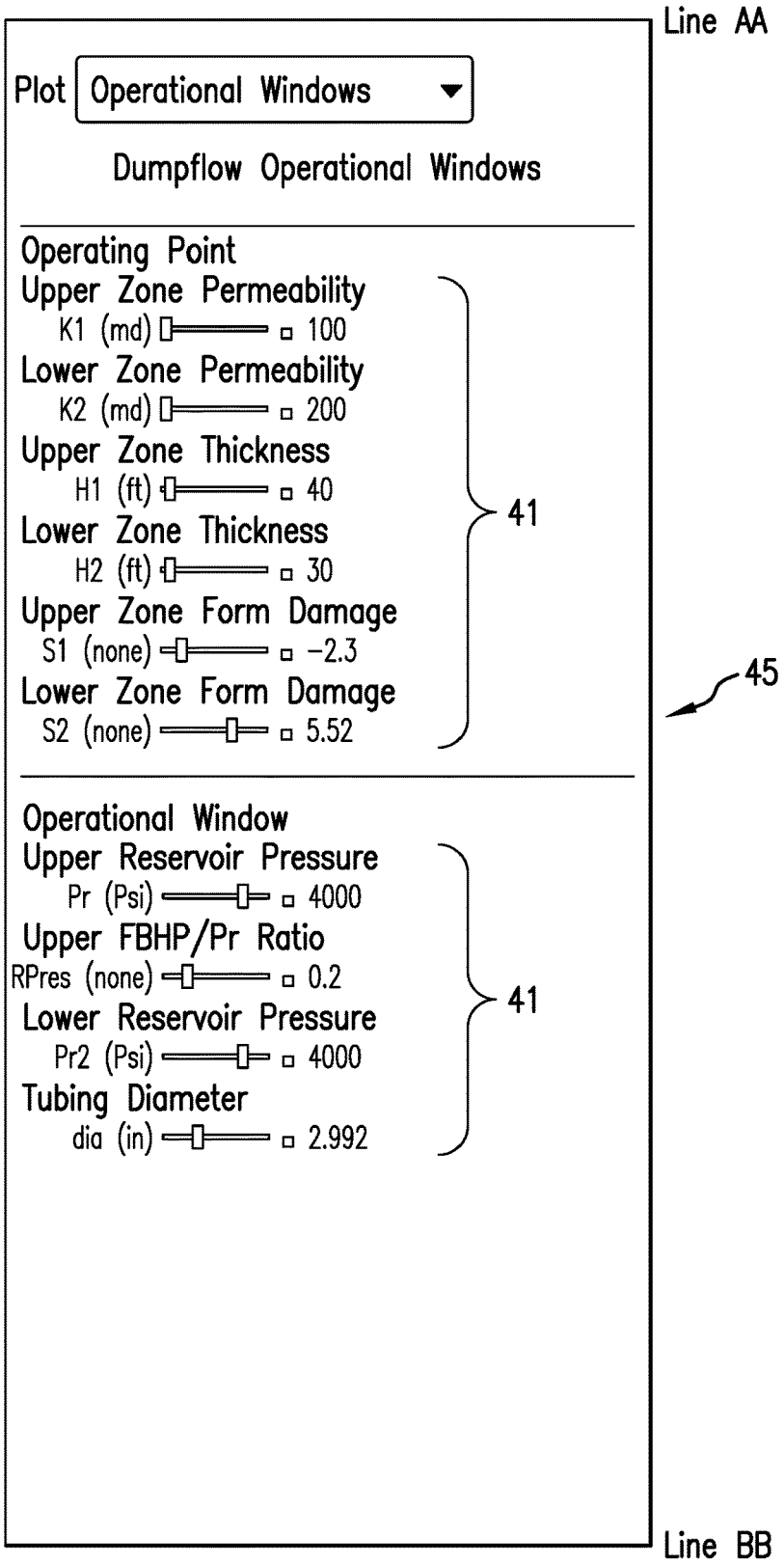
Figure 4L:
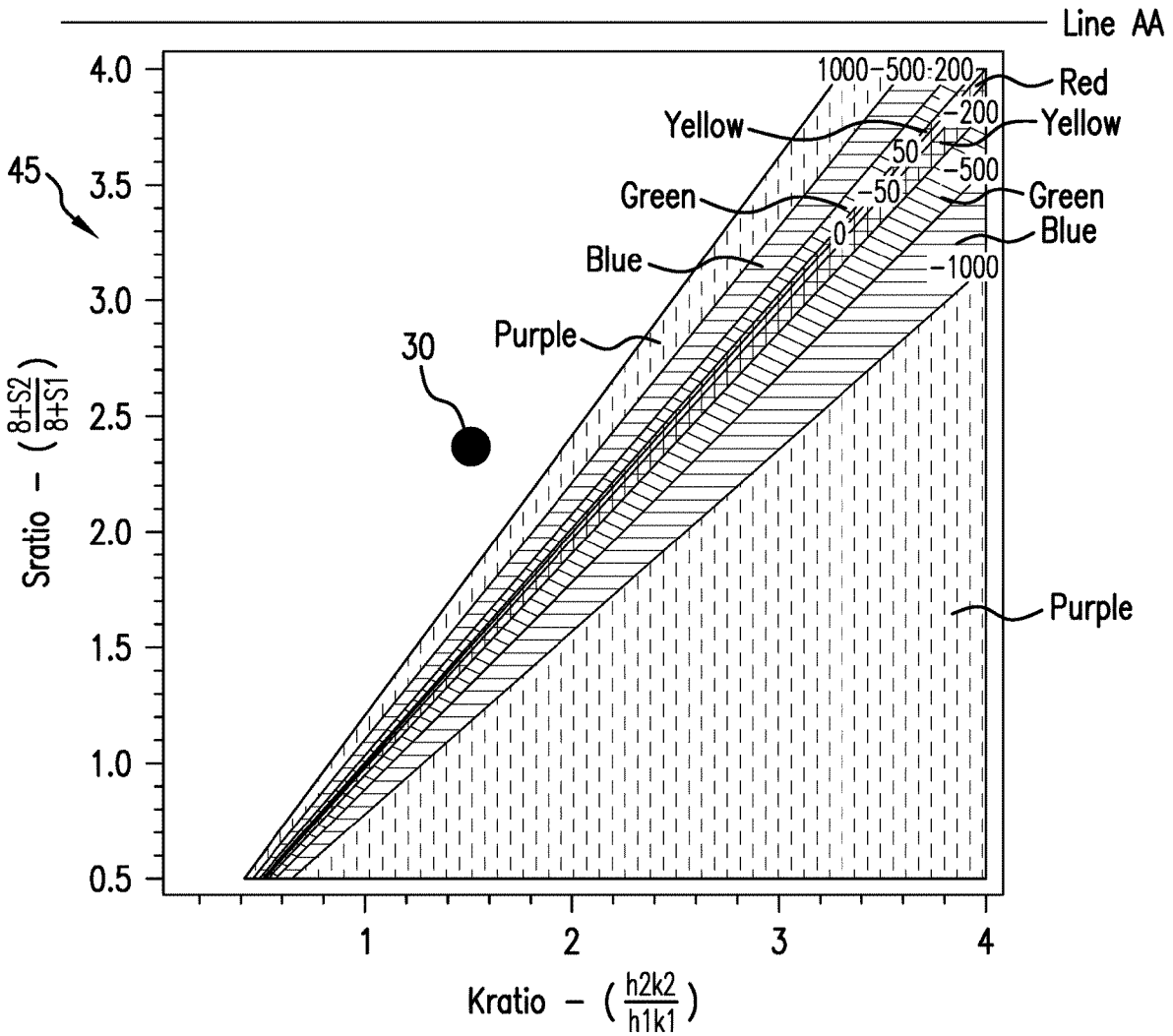

Graphical display 45 represents one image and is illustrated using a composite of three figures, FIGS. 4KK-4MM, with FIG. 4KK being positioned to the left, FIG. 4LL being positioned to the upper right, and FIG. 4MM being positioned to the lower right. It can be appreciated that sliders 41 illustrated in FIG. 4KK are used to easily change values entered into the computer program. When an input value is changed using a slider 41, the computer program automatically updates the graphical display 45 and the graph in FIG. 4LL.

Figure 5:
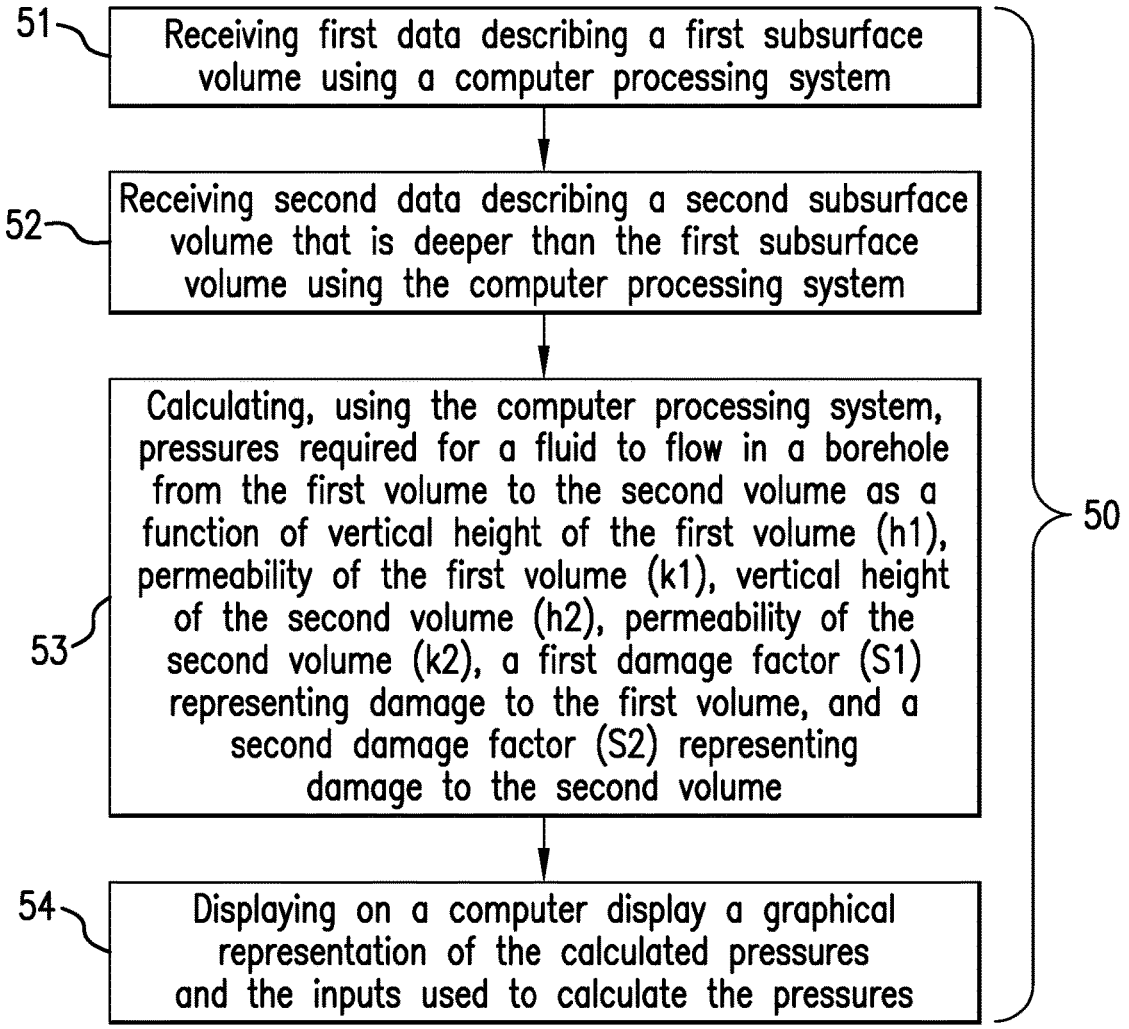
FIG. 5 is a flow chart for a method for presenting dumpflood data to a user.

FIG. 5 is a flow chart for a method 50 for presenting dumpflood data to a user. Block 51 calls for receiving first data describing a first subsurface volume (i.e., upper reservoir) using a computer processing system. Block 52 calls for receiving second data describing a second subsurface volume (i.e., lower reservoir) that is deeper than the first subsurface volume using the computer processing system. Block 53 calls for calculating, using the computer processing system, pressures required for a fluid to flow in a borehole from the first volume to the second volume as a function of vertical height of the first volume (h1), permeability of the first volume (k1), vertical height of the second volume (h2), permeability of the second volume (k2), a first damage factor (S1) representing damage to the first volume, and a second damage factor (S2) representing damage to the second volume. The first data and the second data are used to calculate the pressures and include information about fluids present in each volume. Block 54 calls for displaying on a computer display a graphical representation of the calculated pressures and the inputs used to calculate the pressures.

The method 50 can also include in Block 53 solving a mass balance where the flow rate (q1) of the fluid flowing from the first volume (i.e., upper reservoir) equals the flow rate (q2) of the fluid flowing into the second volume (i.e., lower reservoir). The method 50 can also include using the following equations in Block 53: $q1=0.00708((k1\cdot h1)/(\mu1\cdot FVF1))\cdot\Delta P1/(\text{Log}[re/rw]+S1)$ and $q2=0.00708((k2\cdot h2)/$ $(\mu 2 \cdot FVF2)) \cdot \Delta P2/(Log\ [re/rw]+S2)$ where $\mu 1$ represents viscosity of the fluid flowing from the first volume; $\mu 2$ represents the viscosity of the fluid flowing into the second volume; FVF1 is Formation Volumetric Factor for the first volume representing a change in fluid volume due to a pressure or temperature change; FVF2 is Formation Volumetric Factor for the second volume representing a change in fluid volume due to a pressure or temperature change; re represents the radius of a drainage sump surrounding the borehole; and rw represents the flow radius of the borehole. The method 50 can also include using the following equation in Block 53: $L=(Pr1(RPres-1+(Sratio/Kratio)(1-1RPres))/(0.87-(0.0089\upsilon^2/dh\ Log\ [(0.00001351/dh)+(0.000194/(dh \cdot \upsilon)^{9/10}]^2)$ where Pr1 represents fluid pressure in the first volume; RPres represents the ratio of static fluid pressure to flowing fluid pressure; dh represents the hydraulic diameter of the borehole; and $\upsilon$ represents fluid flow velocity.

Figure 6:
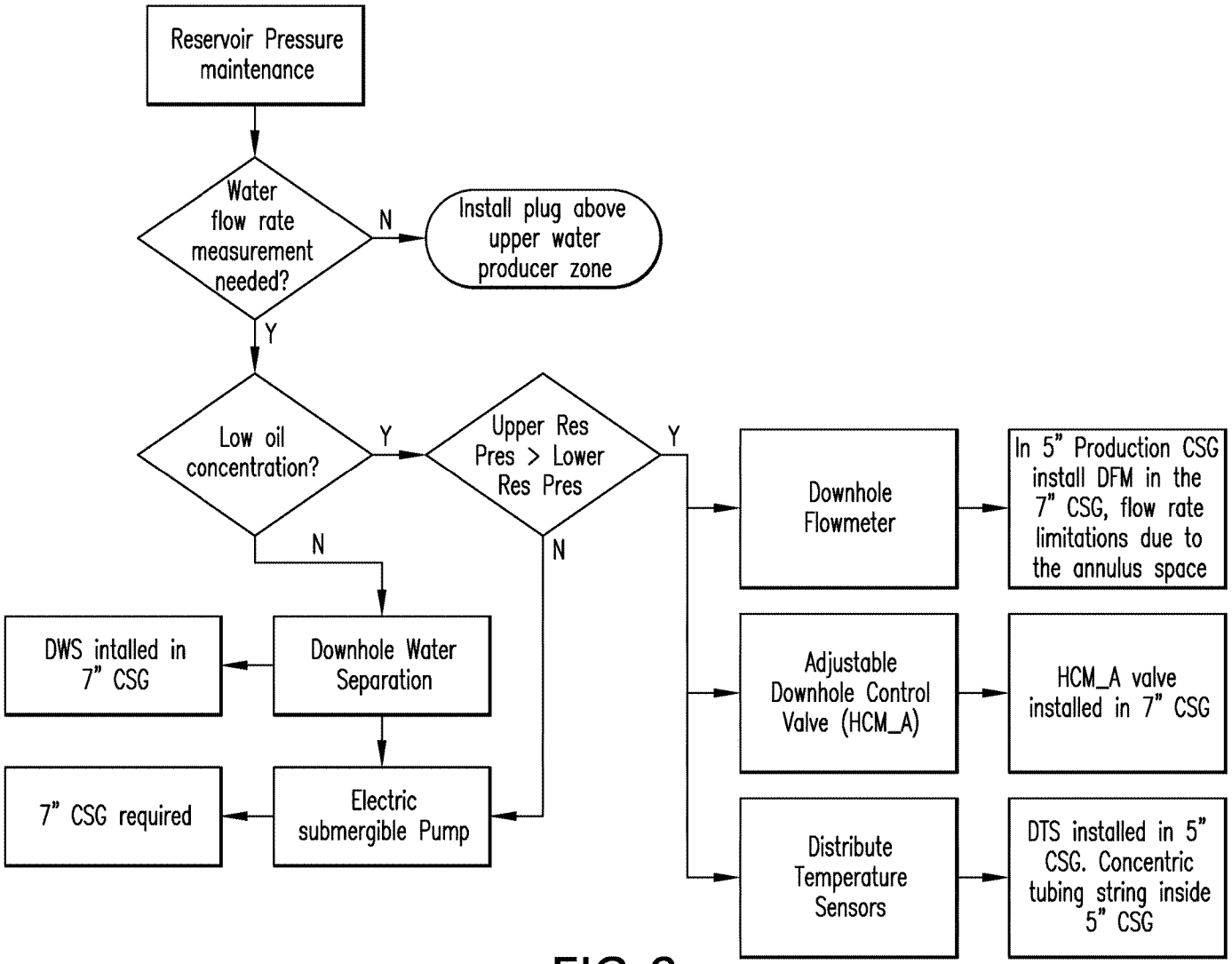
FIG. 6 is a flow chart depicting aspects of identifying various technical solution options for dumpflooding based upon the dumpflood data presented to the user.

It can be appreciated that various technical solution options for dumpflooding may be considered based upon the dumpflood data displayed to the user using the graphical representation concept illustrated in FIG. 3. FIG. 6 is one example of a flow chart depicting aspects of identifying various technical solution options for dumpflooding based upon the dumpflood data presented to the user. The flowchart (FIG. 6) provides an overview of some well completion solutions available to properly inject water from the upper reservoir zone to the lower reservoir zone, through the same wellbore. Generally, the injected water flow rate is required in order to perform a material balance between the reservoirs. If this is not the case, then dump flood is not needed; therefore it would be recommended to produce by commingling both reservoirs until the total water cut achieves the economic limit. At that moment it would make sense to evaluate each reservoir zone, independently, and isolate the zone with the highest water production by installing a plug or closing the reservoir zone with a sliding sleeve for example.

Using dumpflood, the water injected is generally under specifications in terms of oil concentration; high values will affect the injectivity as well as the business profitability. A downhole water separator (DWS) may be installed to separate the oil and water; but the casing (CSG) size may be a restriction (a minimum of 7" casing is needed to install the DWS in one or more embodiments). Once the DWS is installed, at least one electrical submersible pump (ESP) may be required to lift the oil to the surface and inject the water to the lower reservoir zone; in general there is enough downhole space to accommodate the DWS and the ESP. The ESP may be required anyway if the upper reservoir zone is not high enough to compensate for the hydrostatic pressure, friction and the lower reservoir pressure.

In one or more embodiments, the best case in terms of minimum investment will be the operational condition where there is enough injection pressure and low oil concentration; since the effort will be concentrated in water measurement and control. The water flow rate can be measured using a downhole flowmeter or distributed temperature sensors (e.g., distributed along the casing). If there is a small casing size installed in the wellbore, then DTS will be the recommendable technology to be used. In offshore applications, operational flexibility requires the ability to open and close the downhole control valve (HCM_A—adjustable downhole control valve), but again the casing size may determine if this technology can be installed in the hole or not. In summary, most of the available technology can be used to measure, control and inject water downhole in a seven inch casing; smaller casing sizes will require further evaluation to accommodate the equipment inside an intermediate casing rather than the production casing.

In support of the teachings herein, various analysis components may be used, including a digital and/or an analog system. For example, the computer processing system 10, the sensors 4, or other downhole tools may include digital and/or analog systems. The system may have components such as a processor, storage media, memory, input, output, communications link (wired, wireless, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The terms "first," "second" and the like do not denote a particular order, but are used to distinguish different elements. The term "configured" relates to a structural limitation of an apparatus that allows the apparatus to perform the task or function for which the apparatus is configured.

While one or more embodiments have been shown and described, modifications and substitutions may be made thereto without departing from the spirit and scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A non-transitory computer-readable medium comprising computer-executable instructions for installation and/or operation of a dumpflood component by implementing steps on a computer, the steps comprising:

receiving first data describing a first subsurface volume, at least a portion of said first data is derived from a sensor;

receiving second data describing a second subsurface volume that is deeper than the first subsurface volume, at least a portion of said second data is derived from said sensor;

calculating pressures required for a fluid to flow in a borehole from the first volume to the second volume as a function of vertical height of the first volume (hi), permeability of the first volume (kl), vertical height of the second volume (h2), permeability of the second volume (k2), a first damage factor (SI) representing damage to the first volume, and a second damage factor (S2) representing damage to the second volume, wherein the calculating uses the first data and the second data;

creating a graphical representation of the calculated pressures and inputs used to calculate the pressures; and installing and/or operating the dumpflood component in response to the calculated pressures.

2. The medium according to claim 1, wherein S1 relates to damage to the first volume requiring an increase in pressure to cause the fluid to flow at the same rate as an undamaged first volume and S2 relates to damage to the second volume requiring an increase in pressure to cause the fluid to flow at the same rate as an undamaged second volume.

3. The medium according to claim 2, wherein the graphical representation comprises graphing a Kratio on a first axis, an Sratio on a second axis, and the calculated pressures on a third axis, Kratio=(h2·k2)/(h1·k1) and Sratio=(S2+8)/(S1+8).

4. The medium according to claim 3, wherein the graphical representation is in two dimensions.

5. The medium according to claim 4, wherein the calculated pressures are divided into a first group of pressures in which gravity is sufficient to cause the fluid flow and a second group of pressures in which additional pressure above gravity is required to cause the fluid flow.

6. The medium according to claim 5, wherein the first group is plotted on an axis parallel to the axis representing the Kratio and the second group is plotted on an axis parallel to the axis representing the Sratio.

7. The medium according to claim 6, wherein the first group is subdivided into subgroups of pressure ranges, each subgroup of the first group being represented by a different color, and the second group is subdivided into subgroups of pressure ranges, each subgroup of the second group being represented by a different color.

8. The medium according to claim 1, wherein the calculated pressures are represented by heights of water that provide the calculated pressures.

9. The medium according to claim 1, wherein the fluid is water and the second volume contains oil.

10. A method for installation and/or operation of dumpflood component, the method comprising:

receiving first data describing a first subsurface volume using a computer processing system, at least a portion of said first data is derived from a sensor;

receiving second data describing a second subsurface volume that is deeper than the first subsurface volume using the computer processing system, at least a portion of said second data is derived from said sensor;

calculating, using the computer processing system, pressures required for a fluid to flow in a borehole from the first volume to the second volume as a function of vertical height of the first volume (hi), permeability of the first volume (kl), vertical height of the second volume (h2), permeability of the second volume (k2), a first damage factor (SI) representing damage to the first volume, and a second damage factor (S2) representing damage to the second volume, wherein the calculating uses the first data and the second data;

creating a graphical representation of the calculated pressures and inputs used to calculate the pressures;

installing and/or operating the dumpflood component using the computer processing system in response to the calculated pressures; and installing and/or operating the dumpflood component in response to the calculated pressures.

11. The method according to claim 10, wherein calculating comprises solving a mass balance where the flow rate (q1) of the fluid flowing from the first volume equals the flow rate (q2) of the fluid flowing into the second volume.

12. The method according to claim 11, wherein calculating further comprises using the following equations:

$$q1=0.00708((k1\cdot h1)/(\mu1\cdot FVF1))\cdot\Delta P1/(\mathrm{Log}[re/rw]+S1)$$

and $$q2=0.00708((k2\cdot h2)/(\mu2\cdot FVF2))\cdot\Delta P2/(\mathrm{Log}[re/rw]+S2)$$

where μ1 represents viscosity of the fluid flowing from the first volume; μ2 represents the viscosity of the fluid flowing into the second volume; FVF1 is Formation Volumetric Factor for the first volume representing a change in fluid volume due to a pressure or temperature change; FVF2 is Formation Volumetric Factor for the second volume representing a change in fluid volume due to a pressure or temperature change; re represents the radius of a drainage sump surrounding the borehole; and rw represents the flow radius of the borehole.

13. The method according to claim 12, wherein calculating further comprises using the following equation:

$$L=(Pr1(\mathrm{RPres}-1+(Sratio/Kratio)(1-1\mathrm{RPres}))/(0.87-(0.0089\upsilon^2/dh\ \mathrm{Log}[(0.00001351/dh)+(0.000194/(dh\cdot\upsilon)^{9/10}]^2)$$

where Pr1 represents fluid pressure in the first volume; RPres represents the ratio of static fluid pressure to flowing fluid pressure; dh represents the hydraulic diameter of the borehole; and υ represents fluid flow velocity.

14. The method according to claim 10, wherein the dumpflood component comprises a submersible pump.

15. The method according to claim 10, further comprising:

measuring a property associated with flowing a fluid from an upper reservoir to a lower reservoir using a sensor; and using the property for calculating the pressures.

16. The method according to claim 15, wherein the sensor is disposed in a borehole connecting the upper reservoir to the lower reservoir.

17. The non-transitory computer-readable medium according to claim 1, wherein the dumpflood component comprises a submersible pump.

18. The non-transitory computer-readable medium according to claim 1, wherein the dumpflood component comprises a downhole water separator.

19. The method according to claim 10, wherein the dumpflood component comprises a downhole water separator.

20. The method according to claim 10, wherein the dumpflood component comprises a perforating gun.

21. The medium according to claim 1, wherein the installing and/or operating the dumpflood component provides for at least one of (i) promoting flow of the fluid from the first subsurface volume to the second subsurface volume, (ii) separating the fluid flowing from the first subsurface volume to the second subsurface volume into a first component and a second component, and (iii) isolating the first subsurface volume from the second subsurface volume.

22. The method according to claim 10, wherein the installing and/or operating the dumpflood component provides for at least one of (i) promoting flow of the fluid from the first subsurface volume to the second subsurface volume, (ii) separating the fluid flowing from the first subsurface volume to the second subsurface volume into a first component and a second component, and (iii) isolating the first subsurface volume from the second subsurface volume.

* * * * *